US008763423B2

(12) United States Patent
Tattam

(10) Patent No.: US 8,763,423 B2
(45) Date of Patent: Jul. 1, 2014

(54) CARGO CONTAINER TEMPERATURE CONTROL SYSTEM

(75) Inventor: Edwin Francis Tattam, Somerset (GB)

(73) Assignee: Softbox Systems Ltd. (GB)

( * ) Notice: Subject to any disclaimer, the term of this patent is extended or adjusted under 35 U.S.C. 154(b) by 0 days.

(21) Appl. No.: 13/375,151

(22) PCT Filed: May 29, 2010

(86) PCT No.: PCT/GB2010/001059

§ 371 (c)(1), (2), (4) Date: Nov. 29, 2011

(87) PCT Pub. No.: WO2010/136771

PCT Pub. Date: Dec. 2, 2010

(65) Prior Publication Data

US 2012/0072046 A1 Mar. 22, 2012

(30) Foreign Application Priority Data

May 29, 2009 (GB) ..... 0909249.5

(51) Int. Cl.
*F25D 3/06* (2006.01)

(52) U.S. Cl.
USPC ..... 62/457.1; 62/457.2

(58) Field of Classification Search
USPC ..... 62/457.1
See application file for complete search history.

(56) References Cited

U.S. PATENT DOCUMENTS

| | | | | |
|---|---|---|---|---|
| 276,590 | A * | 5/1883 | Irish | 165/80.5 |
| 624,165 | A * | 5/1899 | Bowdish | 217/130 |
| 687,718 | A * | 12/1901 | Bower | 62/441 |
| 2,514,651 | A * | 7/1950 | Kornfeld et al. | 62/457.1 |
| 2,730,151 | A * | 1/1956 | Smith | 383/12 |
| 3,743,130 | A * | 7/1973 | Jorgensen | 383/38 |
| 4,050,264 | A | 9/1977 | Tanaka | |
| 4,324,111 | A * | 4/1982 | Edwards | 62/457.4 |
| 5,533,361 | A | 7/1996 | Halpern | |
| 6,427,475 | B1 * | 8/2002 | DeFelice et al. | 62/457.2 |
| 6,851,276 | B2 * | 2/2005 | Perrins | 62/457.5 |
| 7,422,143 | B2 * | 9/2008 | Mayer | 229/103.11 |
| 8,061,159 | B2 * | 11/2011 | Mogil et al. | 62/457.7 |

(Continued)

FOREIGN PATENT DOCUMENTS

| | | | |
|---|---|---|---|
| AU | 199712980 | B2 | 8/1997 |
| DE | 202005018423 | U1 | 4/2006 |

(Continued)

OTHER PUBLICATIONS

"Sleeve", Oxford English Dictionary, Online Edition [Retrieved from the internet Feb. 20, 2013] http://www.oed.com/search?searchType=dictionary&q=sleeve.*

*Primary Examiner* — Ljiljana Ciric
*Assistant Examiner* — Alexis Cox
(74) *Attorney, Agent, or Firm* — Galvin Patent Law LLC; Brian R. Galvin

(57) ABSTRACT

A temperature control system for a cargo container, including a foldable sleeve having first and second major planes and at least one temperature control pack, the sleeve being attached prior to first use to a major plane of an inside wall of the container operable to retain a temperature control pack within, to maintain a temperature of an atmosphere within the container when closed by virtue of heat transfer with the atmosphere of the container; and to prevent contact with any product.

20 Claims, 10 Drawing Sheets

(56) References Cited

U.S. PATENT DOCUMENTS

| | | | | |
|---|---|---|---|---|
| 8,209,995 | B2 * | 7/2012 | Kieling et al. | 62/457.1 |
| 2002/0050147 | A1 * | 5/2002 | Mai et al. | 62/457.2 |
| 2008/0034788 | A1 | 2/2008 | French | |
| 2013/0020309 | A1 * | 1/2013 | Tattam et al. | 219/441 |

FOREIGN PATENT DOCUMENTS

| | | | |
|---|---|---|---|
| EP | 1291300 | A2 | 3/2003 |
| EP | 1384685 | A1 | 1/2004 |
| WO | WO-2005/007519 | A2 | 1/2005 |

* cited by examiner

CARGO CONTAINER TEMPERATURE CONTROL SYSTEM

FIELD OF INVENTION

The present invention relates to a temperature control system for containers, such as cargo containers which are employed to transport goods in aircraft. In particular, the present invention relates to a passive system for the same.

BACKGROUND TO THE INVENTION

In the field of logistics, that is the field of movement and supply of produce and materials, in particular in the transport of intermediate and finished products, containers have been developed which safely protect from physical damage a wide variety of product. However, certain types of products, such as pharmaceutical and food products not only need protection from physical shock and pressures but also require temperature stability during transportation; otherwise goods can be damaged and be unusable, whether such damage is apparent or not.

For example, in the pharmaceutical industry, product often needs to be maintained within a temperature range: product may be packed in relatively small containers, which containers are relatively fragile—accordingly insulation must provide both physical and thermal stability. Small cargos of pharmaceuticals can be extremely valuable, not just in financial terms, but possibly also in terms of health. Destruction by poor handling of pharmaceuticals can have far-reaching consequences. Equally, in the food industry, fish suppliers will often have chilled fish boxes which are designed to accept, say 20 Kg of product. The fish must be maintained at low temperatures, yet will be placed in containers which require a high degree of strength to prevent spillage.

As the standards of living increases, in developed markets, for example in Europe and North America, tropical foods—that is foods grown in far-away tropical places—are increasingly being stocked by supermarkets, delicatessens and the like. Short pick to distribution centre times in the producing country are matched by air carriers taking goods to the countries of consumption in similar lengths of time, whereby it is not uncommon for fruit to be on the plates of householders within two to three days of having been picked in a far-away country.

However, air transport poses a particular problem: Goods can be transported in tropical heat, packaged and placed upon pallets and the like containers whereby they are presented in aircraft style containers. Such goods may be left on runways at extreme temperatures (+40° C.) and then placed within a hold where low pressures and low temperatures exist during flight. At a destination airport the temperatures may well be sub-zero. A corollary to this is the production of temperature sensitive pharmaceuticals in a "developed" country which pharmaceuticals must be transported to another side of the world with similar temperature variations.

Both the above scenarios place transport managers in difficult positions. For air haulage, containers should weigh little, make use of non-rectangular hold spaces within aircraft; for the goods, they must be protected from shock, be maintained within a narrow temperature range, sometimes being equipped with temperature data loggers whereby a record of temperature within a container may determine whether or not a pharmaceutical is destroyed prior to use because of poor temperature handling. Refrigeration units may be provided with a container whereby temperatures maybe maintained, but then a source of electrical power or fuel for a powered generator is required. An example of such a temperature control system is shown in CN20136863 to Hefei Midea Royalstar Refigeration Company.

To simplify transport with respect to airports, planes and handling equipment, there have been developed aircraft Unit Load Devices (ULDs) which comprise any type of pallet or container that can easily be loaded to the aircraft by a ground handler. Aircraft ULDs are units which interface directly with an aircraft loading and restraint system, without the use of supplementary equipment. There are pre-defined ULDs, such as LD3, LD7, which correspond to standard configurations and can be utilised on certain types of aircraft. There are still further ULDs that are shaped such that they have a rectangular base yet are not generally cylindrical, that is to say they extend outwardly, beyond the sides of the base, as they extend upwardly from the base. KR 20080100401 provides a multi combined packing container is provided to improve the products value of the fresh food through low temperature refrigeration circulation in the current fresh food circulation system. The multi combined packing container comprises first, second third and fourth packing materials—arranged in a fashion similar to a Russian doll assembly, wherein the third packing material is a form of refrigerant pack and is inserted inside the second packing material; the fourth packing material is inserted inside the third packing material.

Other known forms of chilling products such as ice packs comprise polymer coolants packaged within bags can provide simple means to cool products. Coolant gels may also be employed, being inserted into plastics containers, typically being, but when packed do not necessarily offer sufficient heat transfer. However, in the nature of transport containers, the gel packs can move or otherwise become dislodged from a selected place whereby an inappropriate temperature gradient can occur, whereby a required temperature for a medicine, vaccine, food or other product is not maintained; products such as vaccines that have not been maintained within a required temperature range during transport must be disposed of without use. It will be appreciated that if a container of, say, a freezable gel is knocked from a normal placement position and leaks to a joint between two panels of a container, the temperatures encountered within aeroplanes is substantially below 0° C.; subsequent freezing and cooling can damage the container irreparably and damage contents within.

It is notable that there are few passive thermal exchange devices for cargo containers; few can provide sufficient cooling properties; few can remain where placed during transport as a matter of course. Further, in terms of containers, cooling systems need to be easily removable and be capable of being packed flat, along with an associated insulating cargo containers; either they are rigid yet not collapsible or are collapsible yet easily damaged when shifted by fork-lifts and other and/or are complex to assemble.

OBJECT OF THE INVENTION

The present invention seeks to provide a solution to the problems addressed above. The present invention seeks to provide a temperature control system for a transport container which can be manufactured at low cost and can readily and easily be constructed from a flat-pack as is the case of a container within which it can be placed. Furthermore, the present invention seeks to provide a temperature control system for a transport container that when completed can maintain goods placed inside the container within a narrow temperature range.

Additionally, the present invention seeks to provide a passive temperature control system that takes up little space and can be simply used with flat-pack storage containers. The present invention further seeks to provide a temperature control system for a transport container which is compatible with standard Unit Load Device specifications.

STATEMENT OF INVENTION

In accordance with a general aspect of the invention, there is provided a temperature control system for a transport container having a base and at least one side wall and a cover, the temperature control system comprising a foldable sleeve having first and second major planes, which in an unfolded state retain a thermal pack which is attached to a side of the container operable to retain temperature control (thermal packs)| packs within, the sleeve conveniently having a spacer means to maintain a temperature within a closed container by virtue of heat transfer with the thermal pack, yet prevents contact with product.

Conveniently, the sleeve comprises sheet material, such as corrugated plastics or corrugated cardboard, configured to define an aperture for the placement of a standard shape coolant package. Known coolant packages can be manufactured from a plastics material and be filled with a gel material or can comprise one or more plastics bags containing a coolant material which are inserted into a cardboard box. For simplicity, the coolant package will define a body which has a high heat capacity and is operable to maintain a temperature—that is to say the coolant, by virtue of its high thermal capacity, can assist in maintaining a temperature above ambient, in a fashion similar to maintaining a temperature below ambient. Corrugated plastics or corrugated cardboard are materials that are commonly used in transport industries and is both relatively cheap and readily available.

Conveniently, a container operably utilised with the invention comprises at least a base and upstanding wall panels, wherein the base panel corresponds to the first panel type and the wall panels correspond to the second panel type. Preferably, the container is of the type wherein adjacent panels have cooperating tongue and groove edges, whereby the container, when closed, is substantially airtight. By having a container substantially air tight, when cool packs are employed is significant since, not only does an exchange of air with the atmosphere outside the container contribute to an increase in temperature within a container, the exchange of air with the atmosphere outside the container will also bring about condensation of the saturated air when cooled and possible frosting upon the cool packs. It will be realised that, subsequently, any temperature cycling, including frosting can affect the integrity of materials such as cardboard.

In accordance with another aspect of the invention, there is provided an a container including the coolant system; the container can have a variety of forms, but a rectangular box is typically employed, even though it would be possible to have square section or cylindrical section boxes. The walls of such a container are provided with the coolant sleeves. Preferably, the container further comprises one or more insulating cover panels, which insulating cover panels correspond in type with either the first or second panel type, whereby the cover panel can be resiliently retained with respect to an upstanding wall panel.

The insulating panels forming the walls of the container can be fabricated from one or more types of panel including extruded polystyrene, polyurethane foam, expanded polystyrene, cardboard, laminated polyurethane foam, laminated expanded polystyrene. The laminate face can comprise one of card, plywood, polypropylene, aluminium or steel.

Conveniently, a weatherproof sheet is arranged about the assembled container in use. Preferably, the weatherproof sheet provides a thermal barrier. Conveniently the weatherproof sheet is retained by a cargo net, which attaches within a recess of a pallet base to provide an integrated weatherproof container system which is resilient for goods to be transported within the transport container, a thermal sheet surrounds the panels and is retained by a cargo net, which is retained by and co-operates with the base member. Conveniently, the cargo net comprises any one or more of webbing or elasticated cords. Conveniently, the net has feet which locate into channels defined along peripheral edges of the base.

In accordance with a still further aspect of the invention, there is provided a container having on an inside surface of a wall an envelope for supporting a temperature control pack, the envelope comprising an aperture having a width and a depth to accommodate one or more temperature control packs, the temperature control pack being spaced from a product within the container by a spacer element. Conveniently first and second panels of the container are arranged with respect to each other such that an edge member of a first panel locates within a channel defined the second panel. The first and second panels may comprise base panel and a wall panel or a wall panel and a wall panel.

A container temperature control pack in accordance with the present invention may be assembled in a rapid and expeditious manner. The parts making up the temperature control pack may be stacked for storage in a relatively small space, conveniently being prior attached to a panel for a container, and may be associated with a container also arranged in a flat-pack style. A distinct benefit of the present invention is that the construction permits the same size temperature control packs to be utilised in different containers; commonality of parts between ranges of product can provide more cost-effective construction and/or different functionality.

BRIEF DESCRIPTION OF THE FIGURES

For a better understanding of the present invention, reference will now be made, by way of example only, to the Figures as shown in the accompanying drawing sheets, wherein.

DETAILED DESCRIPTION OF THE PREFERRED EMBODIMENTS

There will now be described, by way of example only, the best mode contemplated by the inventor for carrying out the present invention. In the following description, numerous specific details are set out in order to provide a complete understanding to the present invention. It will be apparent to those skilled in the art, that the present invention may be put into practice with variations of the specific.

Figure 1:
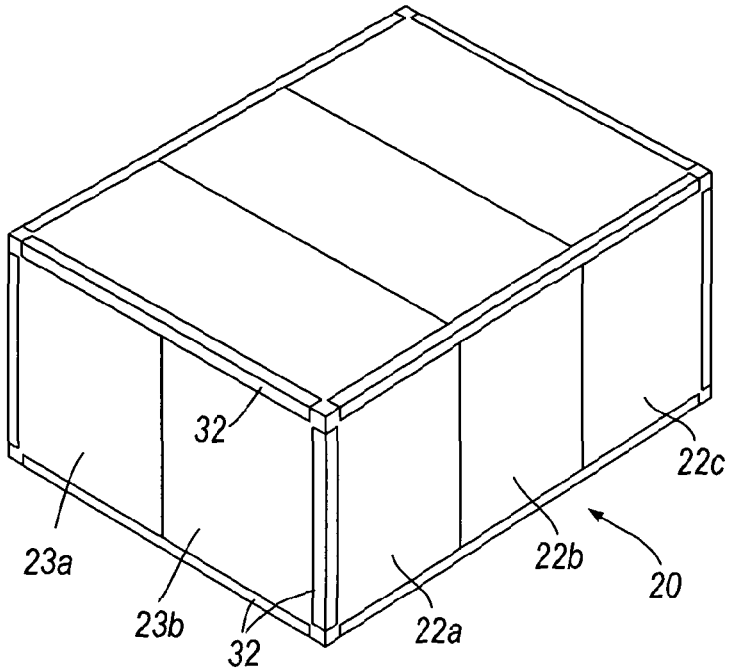
FIG. 1 illustrates a ULD transport container.
Figure 2:
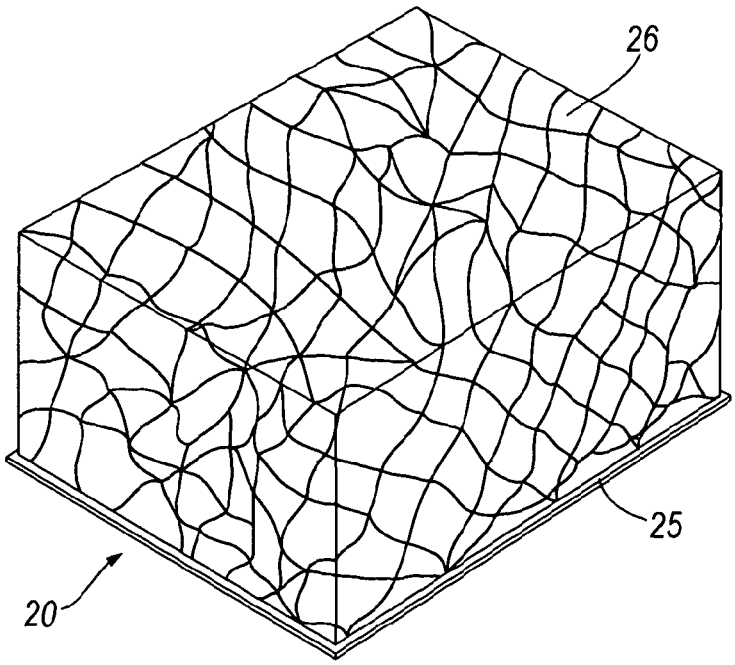
FIG. 2 illustrates a container with weatherproof sheeting.

FIG. 1 shows an example of a container as is disclosed in GB2459392, which has the dimensions of a standard ULD container. Whilst a base panel is not shown in any detail, side panel members 22*a-c* & 23*a, b* are arranged such that a lower edge portion of the panel members are engaged in rebates defined by the base member. In this teaching a rebate is defined between the base member and "L" section elements attached to the base member, but the present invention can be employed in containers manufactured and assembled in different fashions. Conveniently, the material would comprise extruded polystyrene or polyurethane foam and have a thickness of approximately 50-80 mm. The corners of the rectangular container are arranged in mutually similar rebate and edge panel connection. In use, for example, as an LD7 container, the container panels are mounted upon a pallet and then an aluminium base which conforms to specifications of international aircraft standards; a cargo net comprising elasticated webbing 26 is attached via plugs which locate in a perimeter rail of the base. Whilst the insulating panels closely fit together to prevent gaseous exchange—and thus heat transfer—it is common for thermally insulating outer bags to be employed in the transport of temperature sensitive produce and such a bag could be placed around the container and be secured by the cargo net 26. FIG. 2 shows a container with weatherproofing.

Figure 3A:
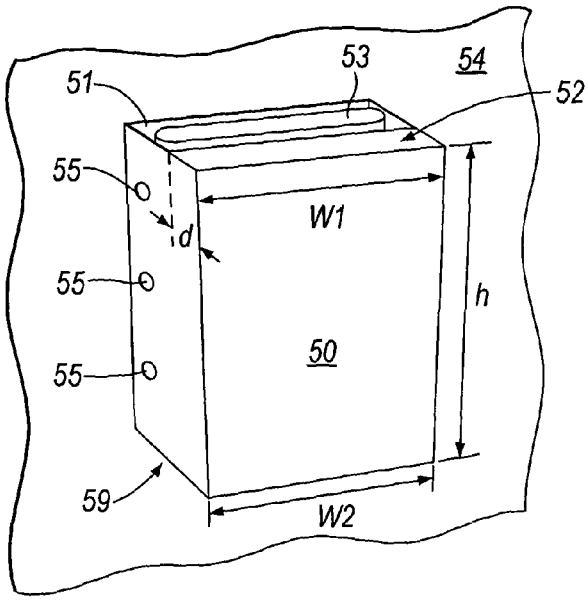
FIGS. 3*a*-3*c* detail a first embodiment of one aspect of the invention.

FIG. 3*a* shows a first embodiment of the invention; sleeve 50 comprises a generally oblong box, open at a top end, 51 and a lower end, 59. The sleeve 50 is attached to an inside wall of a container panel, with the lower end in close proximity to a base of the container. The refrigerant sleeve can comprise, in a simple embodiment, a cardboard enclosure, having a rear wall which is attached to a wall of a container, for example by double sided tape. Cardboard is cheap and readily available, although corrugated plastics can be utilised. The lower end of the sleeve may, in actual fact (though not necessarily preferred), be in touching proximity with the base. Front face 50 of the pack is spaced by a distance d from the coolant pack 53 in use by virtue of spacing means 53 which may comprise a separate cardboard wall or, conveniently a plastics foam spacer. These sleeves comprise containment means for temperature control packs, having a high thermal capacity: A first enclosure 51 is for placement of refrigerant or coolant packs such as gel—packs 53 and similar objects with a high thermal capacity. In use, it lies adjacent a container wall 54; a second element 52 provides a minimum distance, $d_m$, between the gel—packs and the product (not shown). Apertures 55 can be provided in a wall of the first enclosure to enable the position of a coolant pack within to be determined. Equally, such aperture may assist in allowing convection currents to flow.

Figure 3B:
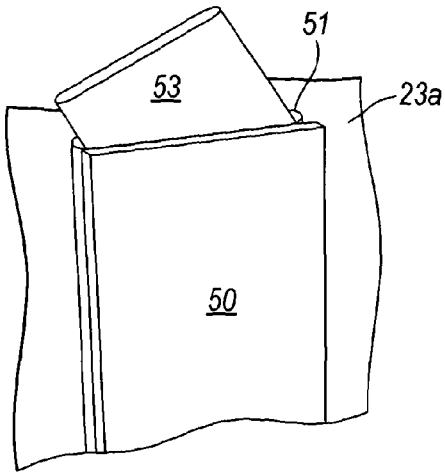
Figure 3C:
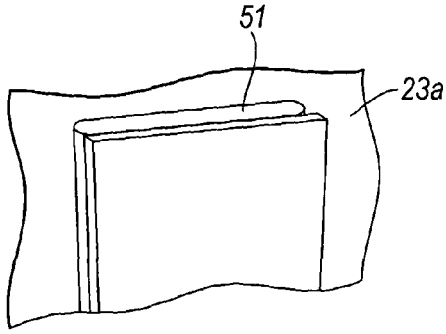

FIG. 3*b* shows a coolant pack 53 in a state of partial state of insertion in an exaggerated off-centre fashion with respect to the sleeve. FIG. 3*c* show how refrigerant pack 53 per FIG. 3*b* is flush with the top of the sleeve. A few thermodynamic concepts are involved here: heat transfer, heat absorption, and phase change. These principles are some of the components of the "zeroth law" of thermodynamics. That is, all systems attempt to reach a state in which heat energy is equally distributed. If an object with a higher temperature comes in contact with a lower-temperature object, it will transfer heat to the lower-temperature object. It is to be noted that certain goods must be maintained below ambient temperature; others at above ambient temperature and some at elevated temperature.

Figure 4:
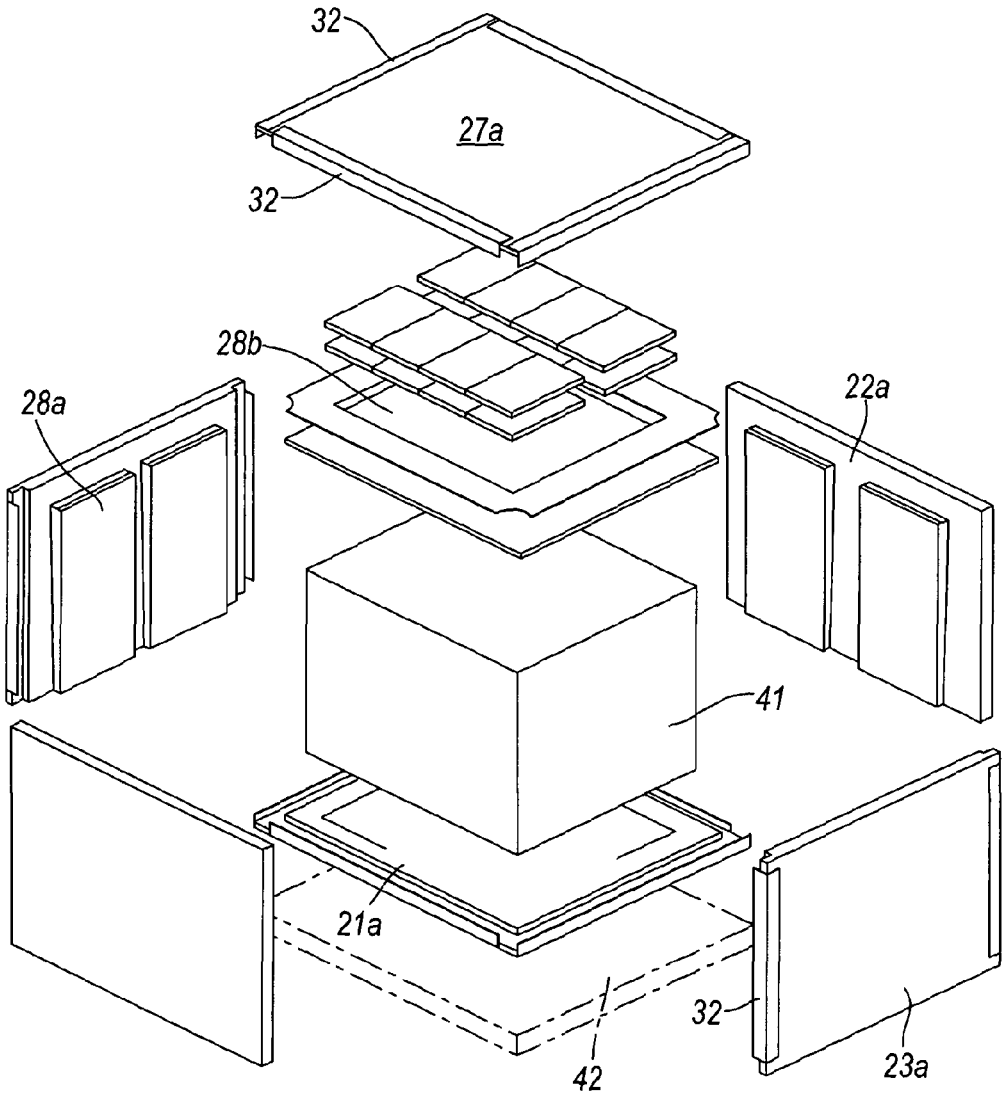
FIG. 4 shows a container with coolant sleeves in accordance with one aspect of the invention.

Turning now to FIG. 4, there is shown the container as shown in FIGS. 2*a* & 2*b*. Box 41 is a box with temperature sensitive contents; it needs to be maintained within a specific, limited temperature range. The invention provides sleeves or envelopes 28*a* attached to the inside walls of the container. Box 41 is mounted upon a base 21*a* which can be supported by a pallet (not shown), which is, in turn, placed upon base member 42. In this Figure, there is also shown shows cardboard envelopes 28*a* and boxes 28*b* which can retain gel packs, for example, which have a high heat capacity whereby to assist in the maintenance of a particular temperature. The base, side and top panels of the container may all be manufactured from plastics foam sheets, such as extruded polystyrene or polyurethane. However, in certain circumstances, the panels may comprise expanded polystyrene sheathed with, for example, cardboard, polypropylene sheeting or other types of sheathing, including glass reinforced plastics.

An advantage of the use of some sheathing materials is that an L-member may be integrally moulded, if the container is one made in accordance with the teaching of GB2459392. However, as shown, the long-side panels 23*a*-23*c* have interlocking features between themselves, conveniently by way of corresponding rebates, whereby to minimise the presence of any gaps therebetween. Panels 23*a* and 23*c* have vertical L-members 32 attached thereto; similarly the short-side panels 24*a*, 24*b* interlock with each other and with adjacent panels of the long-sides, the L-member ensuring that there are no gaps between the corners edges between adjacent side wall panels. Specifically, a first panel defines a rebated channel on an inside face of the panel, the channel being adjacent to at least one edge, the rebate being defined in cross-section by an edge face of the panel and a general L-shape, a first arm of the L-shape section defining, in use, part of the outside wall of the first member, the second arm of the L-shape section having an inside face opposing said edge face of the panel, whereby to define a rebate into which an edge portion of the second panel can be received and resiliently retained therein. The upper insulating panel 27*a*, as mentioned above is generally similar to the base panel and engages with the upper edges of the side-wall panels, the L-members assisting in maintenance of gap-free edges between the side panels. By having separate panels resiliently retained, passage of air between an inside and an outside of a container is prevented.

Figure 5:
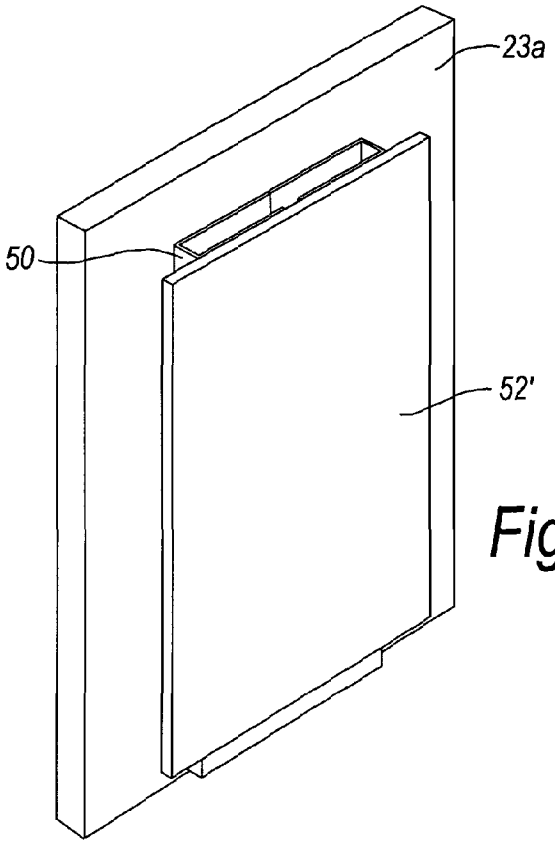
FIG. 5 shows a second embodiment of the invention in perspective view.

Referring now to FIG. 5, there is shown a view of envelope 50*a*, which is attached to an inside face 23*a* of a side panel. This differs from sleeve 50 in that instead of the spacer means being defined by an air barrier between the coolant sleeve 53—as created by an empty box section of cardboard, for example—and the major face of the sleeve shown in the figure, the spacer comprises expanded polystyrene. It is typical for refrigerant packs or gel packs (and other types of materials) to be employed as a refrigerant, to maintain a product within a specified temperature range, to maintain a thermal environment in an insulated shipping container sufficient to meet the product's temperature requirements.

By having a thick spacer, even in the unlikely event of a payload being dislodged within a container, direct contact between the load and a refrigerant pack would not be realised. Such packs have previously been placed loosely in the container, sometimes within boxes. However, disadvantages arose in that the refrigerant packs were liable to congregate in a specific area(s), especially when the containers were roughly handled (which may arise due to the nature of stormy weather and/or a poor landing at an airstrip) providing an uneven temperature distribution within a container, perhaps damaging product which comes into contact with the gel-packs; equally, the gel-packs or similar may become damaged and rupture, potentially spoiling the contents of a container.

Figure 6A:
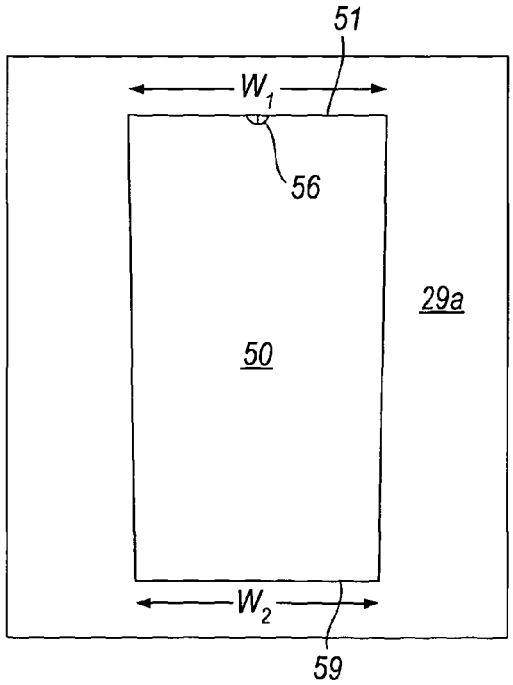
FIGS. 6*a, b* show side and plan views of a sleeve in accordance with the invention.
Figure 6B:
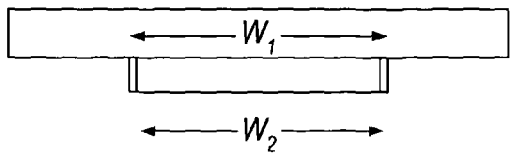

The gel-packs comprise units of a solid, being of a generally rectangular shape. With reference to FIG. 6, which shows a side view of a sleeve in position upon a container wall 29*a*, Applicants have determined that by reducing the width of the enclosure 51 from the top w1 to a width w2, where w2 is less than (say 92-98%) the width of a gel pack w3, then the gel packs can be safely inserted into an enclosure without fear of the pack becoming dislodged as a panel is erected (it will be appreciated, since the height of a side panel of a unit load device is frequently of the order of 2 m or more, that the subsequent insertion of a gel pack is ill-advised, since the gel pack could be liable of not being placed properly within its designated place, if any). The exact width of w2 would be dependent upon the materials employed, cardboard having more give than a typical plastics board. This could also be of advantage in use of the container, to prevent spillage. The envelope may be placed such that it has a gap between a floor of the container, whereby to assist in the use of convection currents to provide a uniform temperature within the atmosphere of the container.

Whilst the dimensions of the gel pack can vary, a pack size that has been found to be of a convenient size and weight (3 Kg) is dimensioned 44.7 cm×28.6 cm×3.6 cm. The envelope is conveniently manufactured from corrugated cardboard. Three or more gel packs may be inserted within an envelope. Since it is a commonly used material in the packaging industry and the skills for fabricating and attaching the envelopes are well known. A length of tape may be attached to an upper section of an aperture, in the middle of a face of the aperture; by placing a lower side of a gel pack in contact with the tape, the pack may be lowered in a controlled fashion. A gel pack may have an indentation upon an edge to assist in this procedure, without fear of the gel pack slipping either side of the tape.

Figure 7:
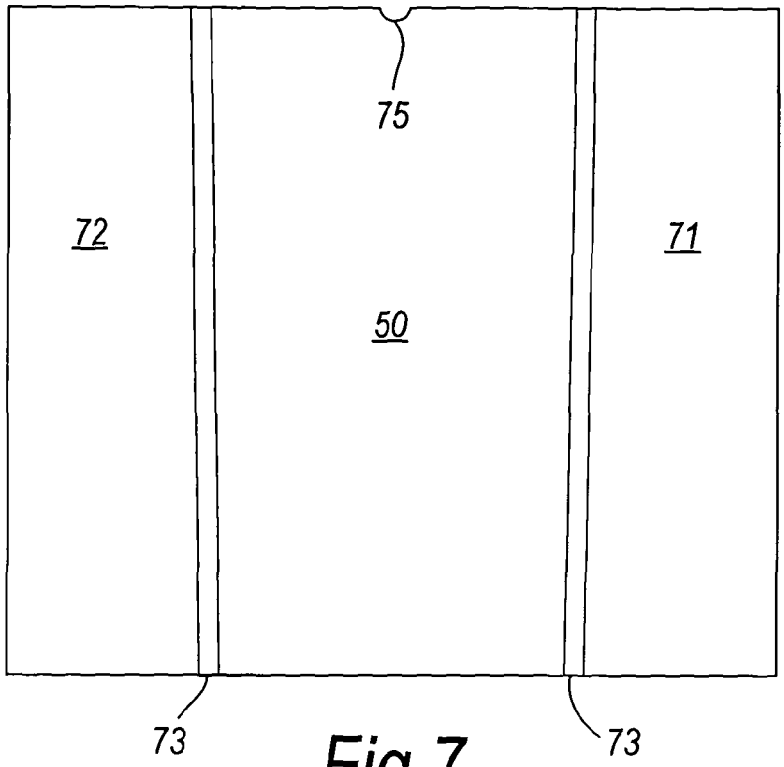
FIGS. 7 & 8 show a cardboard blank and completed sleeve.
Figure 8:
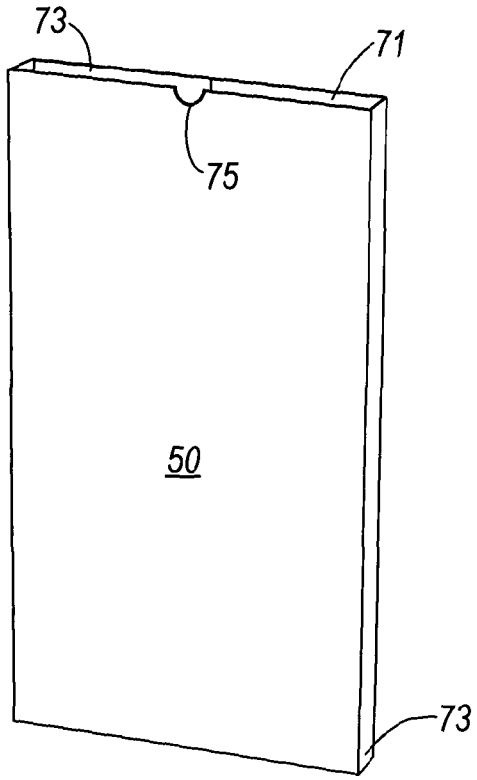
Figure 9A:
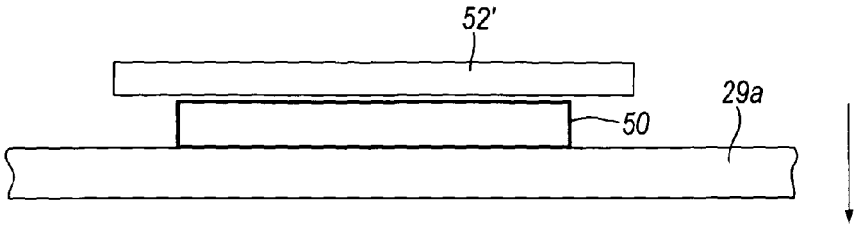
FIGS. 9*a*& *b* show a sleeve in first and second states of compression.
Figure 9B:
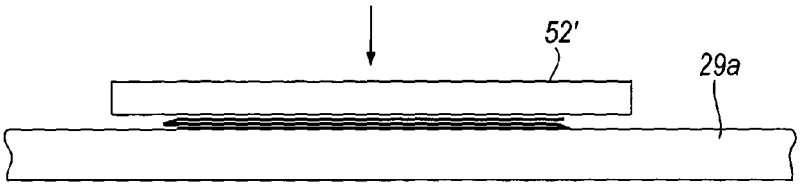

Referring now to FIG. 7, there is shown a plan view of a cardboard sheet prior to initial folding and having a rounded 75 indicia operable to help handlers to locate and position a coolant sleeve when attached to a foam panel and spacer foam. Front face 50 is attached to a spacer foam and is separated b leave 71, 72 separated by intermediate elements 73 which define the thickness of the coolant packages which are installed within a sleeve. FIG. 8 shows how the cardboard tube is formed prior to placement with a spacer and attachment to a wall of a container panel. The advantage of using a thin card or cardboard like material is shown in FIGS. 9*a* and 9*b* where a sleeve is shown in section in open and folded stats. As mention elsewhere, the ability to reduce storage space for unused cartons is particularly welcome, especially in the air freight industry where volume has a cost, not just weight.

Figure 10C:
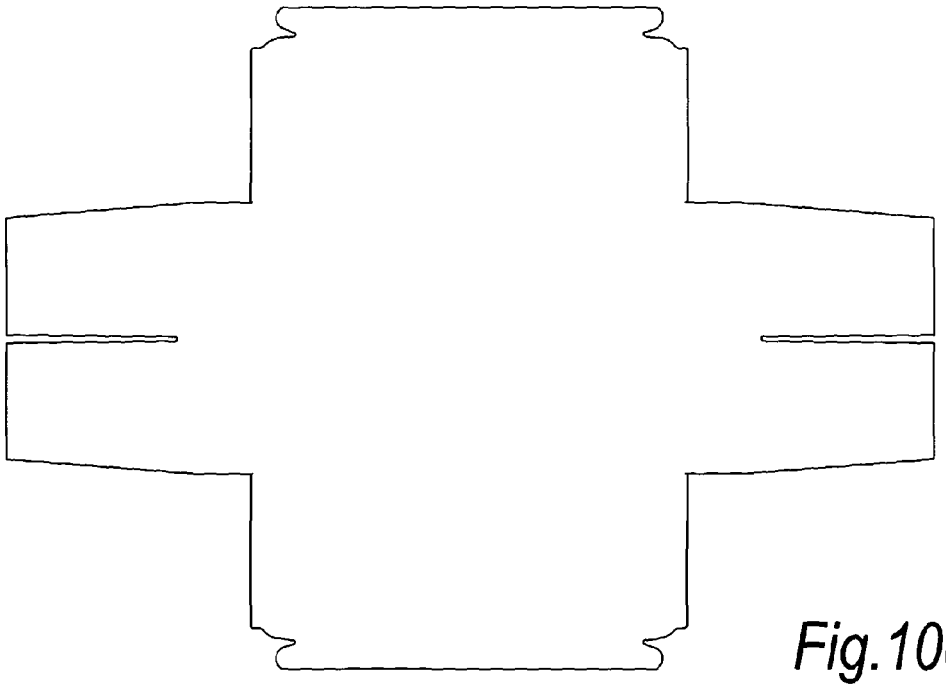
FIGS. 10*a, b* & *c* show a temperature control pack.
Figure 10A:
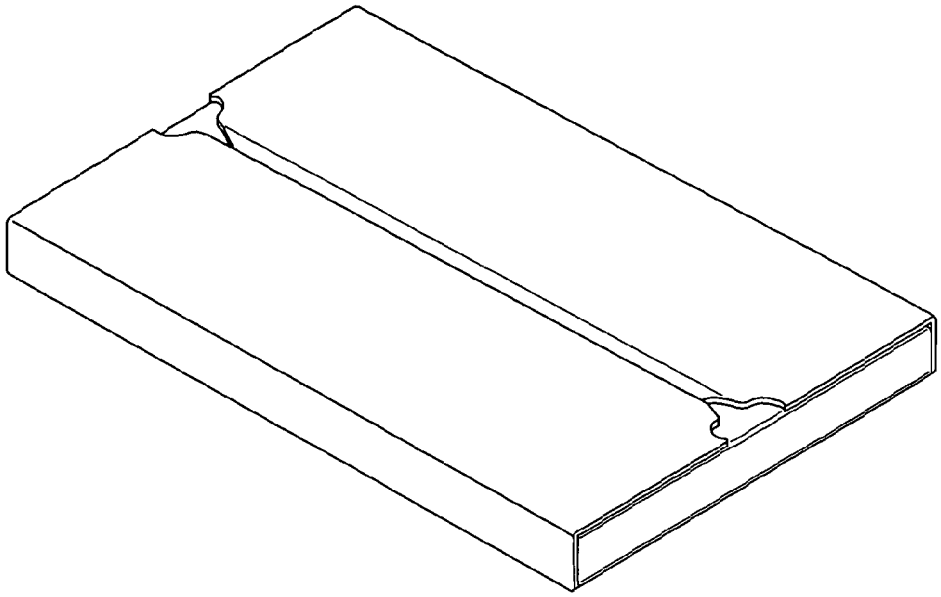
Figure 10B:
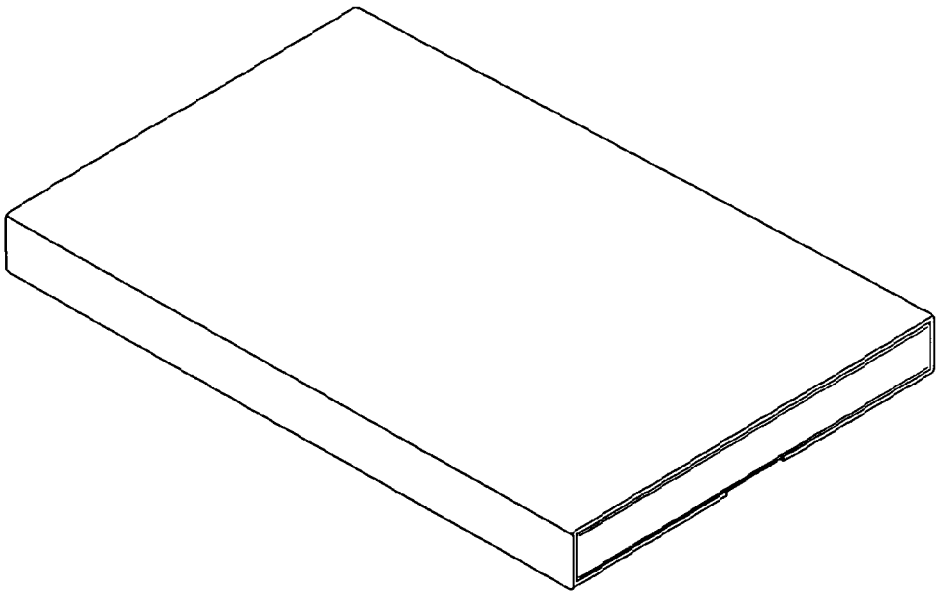
Figure 11:
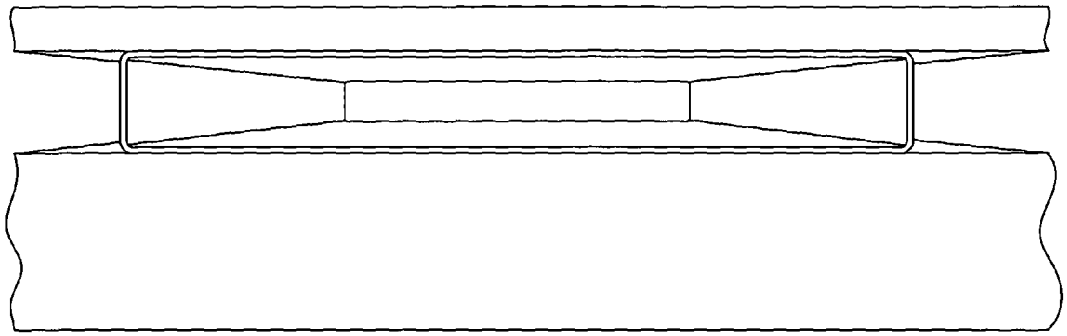
FIG. 11 shows a photograph of an open end of sleeve.
Figure 12:
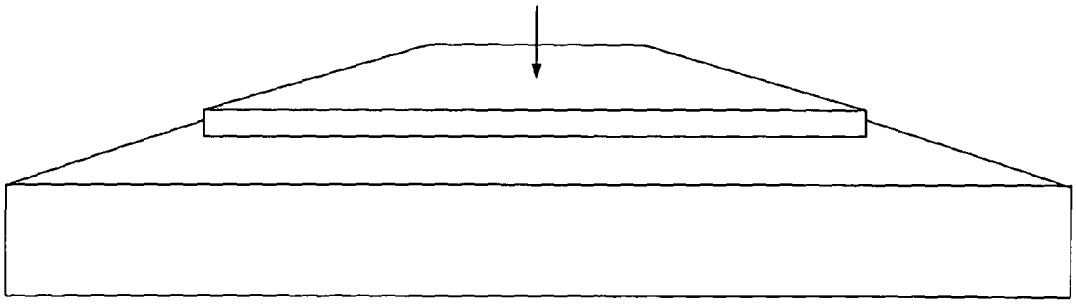
FIG. 12 shows a view of a compressed sleeve.
Figure 13A:
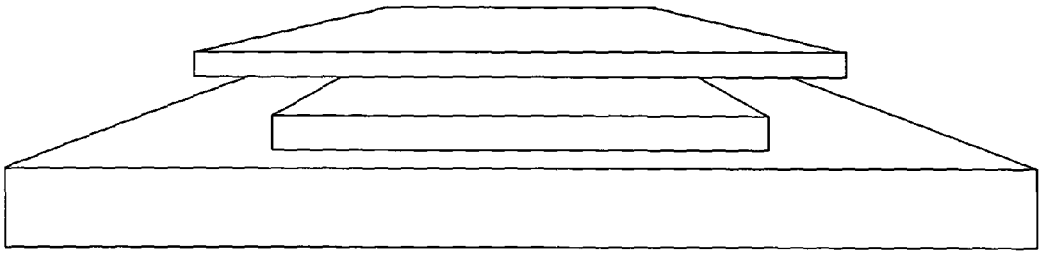
FIGS. 13*a, b* show a temperature control pack from an end view and perspective view respectively.
Figure 13B:
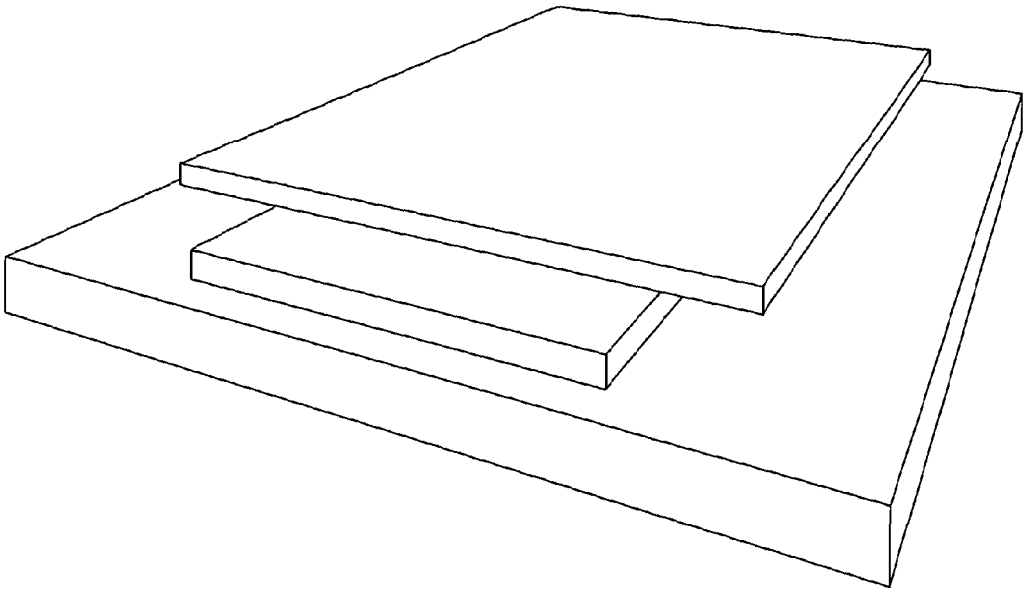
Figure 14:
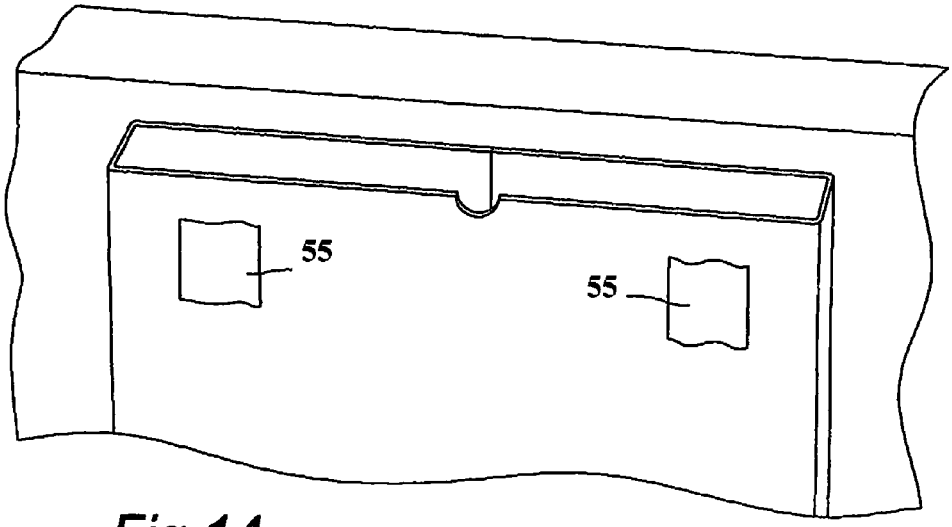
FIG. 14 shows an empty sleeve.
Figure 15:
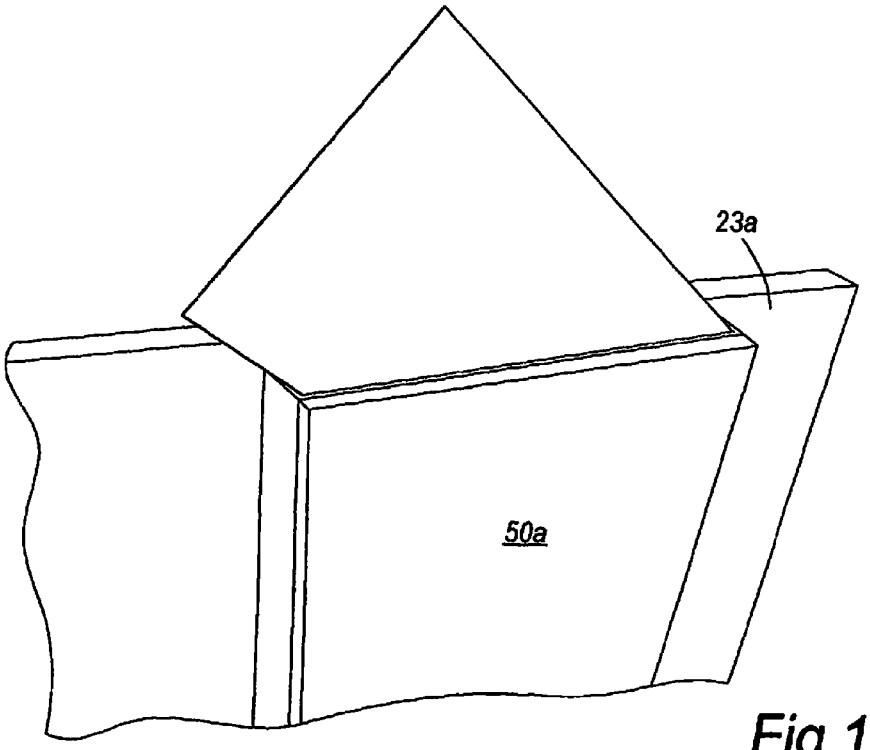
FIG. 15 shows a further embodiment with a partially inserted temperature control pack.

FIGS. 10*a* & 10*b* show first and second perspective views of coolant packs, manufactured from cardboard or plastics sheeting, say of 0.5-2.0 mm in thickness. A suitable card could comprise die-cut corrugated board grade C180W200K175SC; a suitable plastics is low density poly ethylene, LDPE. In use, these are filled with gel packs comprising gel/chlorine biocide mix, the gel being formed from a water/super-absorbent polymer mix at 0.3% polymer to water, as is known. The water would typically be triple treated—carbon filtered, UV treated and chlorinated, to comply with national, international and industrial regulations. A convenient size of gel pack has been found to be 450 mm×287 mm×40 mm. FIG. 10*c* shows an outline of a card which would be folded to produce a refrigerant pack Referring now to FIGS. 11-15, there are shown details of various aspects of the invention, FIG. 11 shows a photograph of an open end of sleeve; which is shown in a compressed state in FIG. 12. A temperature control pack is shown from an end view and from a perspective view respectively I FIGS. 13*a* & 13*b*. An empty sleeve is shown in FIG. 14—a double sided tape is used to enable a plastics buffer element to be attached to face 50 of coolant sleeve. FIG. 15 shows a further embodiment with a partially inserted temperature control pack.

The foam panels of a container are conveniently of a laminated construction, whereby, using different densities of foam a lightweight yet stiff structure can be provided. Conveniently these can be provided by commercially available HCFC-free expanded Polyethylene sheet (LDPE), where there is a closed cell structure with extrusion skin. This provides a low water absorption and water-vapour transmission rate. The foam has a high resiliency and flexibility, excellent cushioning behaviour and excellent thermal insulation properties, with a temperature stability of −40 to +70° C. Commercially available foams of such construction are manufactured by companies such as Knauf Insulation Ltd., Sealed Air Inc. etc. It has also been found that when laminated panels of differing density are employed, there is a reduced tendency of the product panels to bow. Through an appropriate choice of materials, lightweight panels can be selected to provide a resilient container which can elastically deform and return to an original position, albeit in a limited fashion.

It will be appreciated that variations of the insulating base and L-member are possible. For example, the base material may comprise a rebated portion and the L-member horizontal arm would be completely in contact with the underside of the insulating base material. By the provision of such an arrangement, goods can be placed upon a base prior to erection of walls of the container, with a subsequent erection of the walls by the simple act of inserting them within a channel defined in part by the L-members, without fear of the wall collapsing. This has been found to enable a rapid loading of air-cargo pallets, for example. It will be appreciated that a rapid transfer of product shortens the time that product will not be in a temperature-controlled environment. In a most simple embodiment of the invention, only the base insulating member L-members extending from the outside edges thereof. Notwithstanding this, it is preferred that at least the top portions of the container have panels with the L-members extending from outer edges, whereby to enable the goods to be covered in an equally simple fashion. In the alternative, straps could be placed around the top of the container and around the sides, but many of the advantages of the speed of erecting the containers will be lost. Equally, the corner elements of the sidewall should similarly be protected.

In summary, several features worthy of mention are: A) The coolant sleeves or envelopes fold flat to reduce height when shipping to point of use as well as for return logistic operations when systems are flat packed and returned either by air or more often sea container. The actual result of this feature is that the Single Pallet System is reduced in height by 200 mm or 22%, The Half LD7 System by 300 mm or 25% and the Full LD7 System by 500 mm or 25%. B) The insulation, such as XPS plastics provides a buffer layer attached to the front of the corrugated coolant envelope provides an integrated insulation buffer layer that avoids the temperature of chilled product being shipped from freezing as a result of placement directly next to a coolant pack inserted into the system at −20 C. The thickness of such a layer need be only be 15-20 mm, preferably 17.5 for many products, to provide an effective barrier; and C) The tapering of the corrugated coolant envelope from its top aperture of 460 mm to 440 mm (on one model) over distance of approximately 1 m at its bottom is specifically designed to avoid the coolant packs hitting the base insulation panels of the system, causing potential rupturing and leakage of coolant. When inserted into the coolant envelope, the first coolant pack slows or stops approximately 100 mm from the base insulation panel with subsequent packs inserted pushing the first pack gradually down to meet the surface of the base insulation panel.

The invention claimed is:

1. An aviation cargo container temperature control system for use in a flat-pack aviation cargo container having a base and at least one side wall and a cover, the aviation cargo container temperature control system comprising:

at least one sleeve foldable between an unfolded and a compressed state and having first and second major planes and at least one temperature control pack, the sleeve being attachable prior to use along one of its major planes to a major plane of an inside wall of the flat-pack aviation cargo container, each sleeve being operable in a compressed state to permit the flat-pack aviation cargo container, the sleeve being detachable between uses, the sleeve container to be collapsed and in an unfolded state to retain a temperature control pack within, to maintain a temperature of an atmosphere within the flat-pack aviation cargo container, when closed, by virtue of heat transfer between the temperature control pack and the atmosphere of the flat-pack aviation cargo container; and to prevent contact of the temperature control pack with any product being transported in the flat-pack aviation cargo container.

2. The flat-pack aviation cargo container temperature control system according to claim 1, wherein the sleeve further includes a spacer configured to determine a minimum distance between any product being transported in the flat-pack aviation cargo container within the flat-pack aviation cargo container and a temperature control pack within the sleeve.

3. The flat-pack aviation cargo container temperature control system according to claim 1, wherein the sleeve further includes a spacer configured to determine a minimum distance between any product being transported in the flat-pack aviation cargo within the flat-pack aviation cargo container and a temperature control pack within the sleeve, wherein the spacer comprises one of cardboard, an air space defined by cardboard or plastics, and a plastics insulation layer.

4. The flat-pack aviation cargo container temperature control system according to claim 1, wherein the sleeve comprises sheet material configured to define an aperture for the placement of a standard shape coolant package.

5. The flat-pack aviation cargo container temperature control system according to claim 1, wherein the sleeve has apertures in its walls whereby to enable the contents of the sleeve to be viewed.

6. The flat-pack aviation cargo container temperature control system according to claim 1, wherein the sleeve has, in use, an upper section and a lower section, the internal width of the upper section being dimensioned to allow the passage of a temperature control pack into the aperture of the sleeve, the internal width of the sleeve at the lower section being less than a width of a temperature control pack.

7. The flat-pack aviation cargo container temperature control system according to claim 1, wherein the at least one temperature control pack is manufactured from a plastics material and is filled with a thermally insulating gel material.

8. The flat-pack aviation cargo container temperature control system according to claim 1, wherein the temperature control pack is manufactured from cardboard and is filled with a gel material within a plastics bag.

9. A sleeve for use in an aviation cargo container in accordance with claim 1.

10. A flat pack aviation cargo container with a temperature control system, the flat pack aviation cargo container having a base and at least one side wall and a cover, operable to carry a product placed upon the base, said temperature control system comprising at least one sleeve foldable between an unfolded and a compressed state, the sleeve having first and second major planes, and the temperature control system comprising at least one temperature control pack, one of the major planes of the sleeve being fixedly attached to a wall portion of the flat pack aviation cargo container, wherein the sleeve is detachable between uses of the flat pack aviation cargo container, wherein the sleeve is further operable in a compressed state to permit the flat pack aviation cargo container to be collapsed and in an unfolded state to retain the temperature control pack, to maintain a temperature of an atmosphere within the container when closed by virtue of heat transfer with the atmosphere of the container; and, to prevent contact of the temperature control pack with any product being transported in the flat-pack aviation cargo.

11. The flat pack aviation cargo container according to claim 10, wherein the sleeve further includes a spacer configured to provide a minimum distance between product within the container and the temperature control pack within the sleeve.

12. The flat pack aviation cargo container according to claim 10, wherein the sleeve further includes a spacer configured to provide a minimum distance between any product being transported in the flat-pack aviation cargo container and the temperature control pack within the sleeve, wherein the spacer comprises one of cardboard, an air space defined by cardboard or plastics, and a plastics insulation layer.

13. The flat pack aviation cargo container according to claim 10, wherein the sleeve comprises sheet material configured to define an aperture for the placement of a standard shape temperature control pack.

14. The flat pack aviation cargo container according to claim 10, wherein the sleeve has viewing apertures in its walls whereby to enable the contents of the sleeve to be viewed.

15. The flat pack aviation cargo container according to claim 10, wherein the sleeve has, in use, an upper section and a lower section, the internal width of the upper section being dimensioned to allow the passage of the temperature control pack into the aperture of the sleeve, the internal width of the sleeve at the lower section being less than the width of a temperature control pack.

16. The flat pack aviation cargo container according to claim 10, wherein each temperature control pack is manufactured from a plastics material and is filled with a gel material having a high thermal capacity.

17. The flat pack aviation cargo container according to claim 10, wherein each temperature control pack is manufactured from cardboard and is filled with a gel material within a plastics bag.

18. The flat pack aviation cargo container according to claim 10, wherein the first and second major planes are fabricated from one or more types of panel including extruded polystyrene, polyurethane foam, expanded polystyrene, cardboard, laminated polyurethane foam and laminated, expanded polystyrene.

19. The flat pack aviation cargo container according to claim 10, wherein the panel is laminated and the outer laminate is selected from one or more materials of the group comprising: card, plywood, polypropylene, aluminum and steel.

20. A sleeve for use in a flat pack aviation cargo container according to claim 10.

* * * * *